US008465177B2

(12) United States Patent
Yu

(10) Patent No.: US 8,465,177 B2
(45) **Date of Patent: *Jun. 18, 2013**

(54) HEAT DISSIPATION ENHANCED LED LAMP

(76) Inventor: Chih-Ming Yu, Hsinchu (TW)

( * ) Notice: Subject to any disclaimer, the term of this patent is extended or adjusted under 35 U.S.C. 154(b) by 1034 days.

This patent is subject to a terminal disclaimer.

(21) Appl. No.: 12/457,718

(22) Filed: Jun. 19, 2009

(65) Prior Publication Data

US 2010/0320902 A1 Dec. 23, 2010

(51) Int. Cl.
*F21V 29/00* (2006.01)

(52) U.S. Cl.
USPC ..... 362/294

(58) Field of Classification Search
USPC ..... 315/32, 46, 48, 49, 50, 59, 115–117, 315/246; 362/257, 580, 294, 126; 313/46–50
See application file for complete search history.

(56) References Cited

U.S. PATENT DOCUMENTS 6,580,228 B1 * 6/2003 Chen et al. ..... 315/185 R
7,566,912 B2 * 7/2009 Lee et al. ..... 257/98
7,883,242 B2 * 2/2011 Ng et al. ..... 362/249.06
2001/0012200 A1 * 8/2001 Edwards et al. ..... 361/760
2002/0126491 A1 * 9/2002 Chen ..... 362/363
2008/0019123 A1 * 1/2008 Catalano et al. ..... 362/157
2008/0224849 A1 * 9/2008 Sirhan ..... 340/521
2009/0080187 A1 * 3/2009 Chou ..... 362/231
2010/0320902 A1 * 12/2010 Yu ..... 315/32
2010/0320903 A1 * 12/2010 Yu ..... 315/32

* cited by examiner

*Primary Examiner* — Mind D A
(74) *Attorney, Agent, or Firm* — Lowe Hauptman Ham & Berner, LLP

(57) ABSTRACT

A LED lamp which could directly replace an ordinary tungsten, halogen, or electricity-saving light bulb includes a filament, a lamp base and a thermally conductive electric insulator. The filament includes at least one AC LED device, and the thermally conductive electric insulator is filled in a cavity of the lamp base to mechanically contact with the filament and an electrode of the lamp base. When the AC LED device is powered on, the thermally conductive electric insulator provides a thermal channel to transfer heat from the filament to the electrode for heat dissipation enhancement. The LED lamp can be directly inserted into an ordinary bulb socket that is generally used in lighting fixtures, without having to modify the system of the lighting fixtures or use an additional adapter.

19 Claims, 6 Drawing Sheets

HEAT DISSIPATION ENHANCED LED LAMP

FIELD OF THE INVENTION

The present invention is related generally to electric lamps and, more particularly, to a LED lamp which could directly replace an ordinary tungsten, halogen, or electricity-saving light bulb.

BACKGROUND OF THE INVENTION

A light emitting diode (LED) lamp using a direct current (DC) LED device as the filament must be equipped with a power converter for converting the alternating current (AC) power voltage into a DC input voltage for the DC LED device. The power converter not only requires additional component cost for the LED lamp, but also cannot fit entirely into the standard lamp bases of ordinary light bulbs. For a LED lamp to be equipped with a power converter, it is necessary to develop special molds to produce containers and corresponding mechanism different from those of ordinary light bulbs to fit the power converter therewithin, which nevertheless increases the cost and volume of the LED lamp. On the other hand, a DC LED device generates heat when it is powered on and therefore, an additional heat dissipation mechanism is required to handle the heat. If the heat is not effectively dissipated, the resulting high temperature will reduce the emissive efficiency and service life of the DC LED device and produce other adverse effects such as wavelength shift. Moreover, the power converter, particularly the inductor and integrated circuit therein, also generates heat during power conversion, and the consequent high temperature may damage the inductor and integrated circuit and cause failure of the LED lamp accordingly. The problems caused by insufficient heat dissipation are aggravated especially in high power applications, such as in lighting fixtures for illumination purposes, where the DC LED device generates relatively more heat. To adapt to the relatively small space within ordinary lamp bases, some LED lamps use a plurality of low power lamp type LED devices in conjunction with a simple bridge rectifier circuit. However, low power LED devices are poorly accepted in the market due to their generally low brightness, and these LED lamps tend to have serious light attenuation problems as a result of poor heat dissipation.

In recent years, AC LED devices are maturing technically, have improved in brightness, and therefore have had commercial value. An AC LED device includes a plurality of serially and/or parallel connected LED electronic elements manufactured on an epitaxial chip. The epitaxial chip is packaged and then connected in series with a resistor having a particular resistance so as to withstand high voltage, e.g., 110 V or 220 V, mains electricity, thus dispensing with the power converter or rectifier circuit required for a DC LED device. In consequence, the cost of an AC LED lamp is lowered in comparison with its DC counterpart, and the circuit related quality issues reduced. An AC LED device, though conveniently applicable in small spaces, still demands heat dissipation. This is especially true in high power applications, such as lighting fixtures for illumination purposes, where the AC LED device generates relatively more heat. If a heat dissipating device is added, the resultant LED lamp will be bulky and costly. However, if no additional assistance is provided to enhance heat dissipation from the AC LED device, the emissive efficiency and service life of the AC LED device will be reduced, wavelength shift is likely to happen, and even worse, the LED epitaxial chip may be burned out.

SUMMARY OF THE INVENTION

An object of the present invention is to provide a LED lamp which enhances the heat dissipation of the AC LED device in the LED lamp.

Another object of the present invention is to provide a LED lamp which could directly replace an ordinary tungsten, halogen, or electricity-saving light bulb.

A LED lamp according to the present invention comprises a filament, a lamp base and a thermally conductive electric insulator. The filament includes at least one AC LED device, and the thermally conductive electric insulator is filled in a cavity of the lamp base to mechanically contact with the filament and an electrode of the lamp base. When the AC LED device is powered on, the thermally conductive electric insulator provides a thermal channel to transfer heat from the filament to the electrode for heat dissipation enhancement.

Standard lamp bases for ordinary light bulbs can be selected for the lamp base of a LED lamp according to the present invention, and thus the LED lamp could be inserted into the ordinary bulb sockets that generally used in lighting fixtures, without having to modify the system of the lighting fixtures or use an additional adapter.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
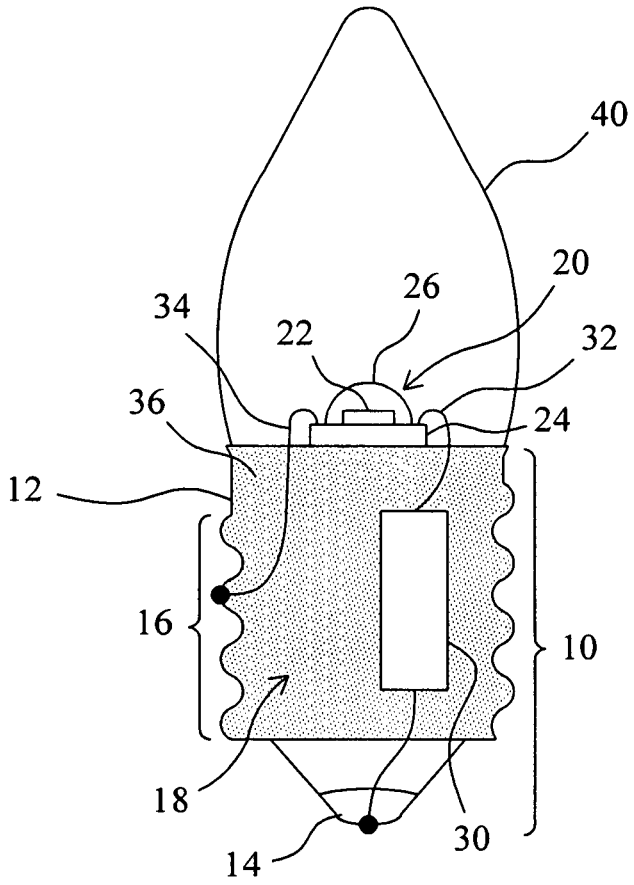
FIG. 1 is a cross-sectional view of a LED lamp in a first embodiment according the present invention.
Figure 2:
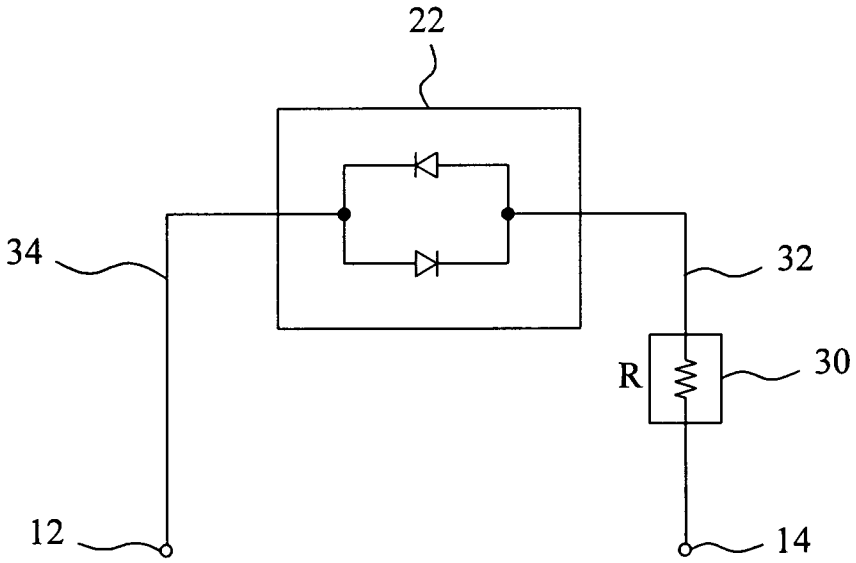
FIG. 2 shows an equivalent circuit of the LED lamp depicted in FIG. 1.

FIG. 1 provides a first embodiment according to the present invention, in which a standard lamp base 10 for use with a small light bulb is used to accentuate the features of the present invention. The lamp base 10 has two electrodes 12 and 14 for receiving an AC power source. As would be understood by a person of ordinary skill in the art, the electrode 12 is a metal housing having a spiral-threaded configuration 16 and a cavity 18 therein. In this embodiment, an AC LED device 20 is used as the filament of the LED lamp, which includes an AC LED epitaxial chip 22 bounded on a leadframe 24 and covered with an encapsulant 26. As the LED packaging is a well-known technique, the package structure of the AC LED device 20 is not detailed in the drawing for the sake of simplicity. A resistor 30 has one end soldered to the electrode 14 and an opposite end connected to a wire 32 that is soldered to the AC LED device 20. Another wire 34 has its two ends soldered to the electrode 12 and the AC LED device 20, respectively. This LED lamp has the equivalent circuit shown in FIG. 2, in which the AC LED epitaxial chip 22 and the resistor 30 are connected in series between the electrodes 12 and 14. As would be understood by a person of ordinary skill in the art, a so-called AC LED epitaxial chip includes LED electronic elements oriented in two opposite directions and connected in parallel between two pins, with at least one LED electronic element in each direction. The LED electronic elements oriented in the two opposite directions are lit during the positive and negative half cycles of the AC power source, respectively. The resistor 30 has a resistance R chosen according to the current intensity required by design. The resistor 30 also serves to protect the AC LED epitaxial chip 22. More specifically, when a surge occurs in the AC power source connected to the electrodes 12 and 14, the resistor 30 will absorb most of the surge voltage. Referring back to FIG. 1, a major feature of the present invention is to fill the cavity 18 with a thermally conductive electric insulator 36 such that the thermally conductive electric insulator 36 is in mechanical contact with the electrode 12 and the filament, i.e. the leadframe 24 in this case, to provide a thermal channel to transfer the heat generated by the AC LED epitaxial chip 22 to the electrode 12 when the AC LED epitaxial chip 22 is powered on to emit light, thereby enhancing the heat dissipation therefrom. As would be understood by a person of ordinary skill in the art, the leadframe 24 typically includes a metal plate for facilitating heat dissipation from the AC LED epitaxial chip 22. Therefore, by attaching the leadframe 24 to the thermally conductive electric insulator 36, good thermal conduction effect can be achieved. In addition to enhance the heat dissipation from the AC LED epitaxial chip 22, the thermally conductive electric insulator 36 also assists in heat dissipation from the resistor 30 because the resistor 30 is buried therein.

For the thermally conductive electric insulator 36, it may select epoxy resin, or thermal conductor powder such as aluminum oxide, aluminum nitride, boron nitride, or any other thermally conductive materials in powder form, or a mixture thereof. Table 1 shows experiment results of using three different thermally conductive materials in the LED lamp of FIG. 1.

TABLE 1

| Thermally conductive electric insulator 36 | Voltage of AC power source | Power consumed by AC LED device 20 | Output brightness (lm) | Condition after being lit continuously for 1000 hours |
|---|---|---|---|---|
| Epoxy resin | 110 V | 1 | 65 | No abnormality detected, except for relatively high temperature |
| Epoxy resin + aluminum oxide powder | 110 V | 1 | 68 | No abnormality detected |
| Aluminum oxide powder | 110 V | 1 | 68 | No abnormality detected |

As shown in Table 1, when epoxy resin, which has a lower thermal conductivity, was used as the thermally conductive electric insulator 36, a higher temperature was detected after the LED lamp was powered on. On the other hand, the mixture of epoxy resin and thermal conductor powder has a higher thermal conductivity, and therefore no abnormality was found during the lighting test. Good thermal conduction effect was also obtained by directly using thermal conductor powder, filled into the cavity 18 and compacted, as the thermally conductive electric insulator 36. In general, the LED lamp under test had satisfactory output brightness, and substantially no abnormality was detected after the LED lamp was lit continuously for 1000 hours. Other materials may also be used as the thermally conductive electric insulator 36, which preferably has a thermal conductivity ranging from 0.25 to 30 W/mK.

As shown in FIG. 1, the LED lamp according to the present invention has approximately the same size as the lamp base 10, possesses good heat dissipation ability, and is capable of high power applications that are unachievable by the prior art devices. Ordinary light bulbs are equipped with standard lamp bases. For example, lamp bases under the standards E12, E14, E17, E26 and E27 are for the ordinary tungsten light bulbs, and MR16 and GU10 lamp bases are for the ordinary halogen light bulbs. The lamp base of an ordinary halogen light bulb has an electrode formed as a columnar metal housing and separated from the other electrode by an electric insulator. Some other standard lamp bases use two needle-like electrodes that are insulated from each other. The lamp base for a LED lamp according to the present invention can be one of ordinary tungsten or halogen light bulbs or other standard lamp bases where there is always a cavity to be filled with the thermally conductive electric insulator 36, and in consequence at least one electrode serves to facilitate heat dissipation from the filament of the LED lamp. As the electrodes of standard lamp bases are exposed outside, fair heat dissipation effect is attainable.

Referring to FIG. 1, a lamp cover 40 may be further added to the LED lamp, depending on demands. The lamp cover 40 can be a glass cap, a plastic cap, an epoxy resin cap, or a silicone cap. If a glass cap or a plastic cap is selected, it is bounded to an end of the lamp base 10 by a mechanical means such as gluing, mortise-and-tenon engagement, or screw thread engagement. If an epoxy resin cap or a silicone cap is selected, it is dispensed over the filament in an amount sufficient to completely cover the filament, and the epoxy resin or silicone is heated and cured if necessary. The lamp cover 40 functions as a protective shell for preventing moisture, dust, or external force from affecting internal components of the LED lamp. Besides, the lamp cover 40 also serves as an optical component. More specifically, the lamp cover 40 may be frosted or configured with geometric patterns so as to produce the desired optical effects. The frosted structure of the lamp cover 40 can be formed by sand blasting, etching, electrostatic powder coating, coating with silicone, spraying with paint, or injection molding.

Alternatively, the filament may include a circuit board to be bounded with the AC LED epitaxial chip 22 thereon. In this case, the circuit board is attached on the thermally conductive electric insulator 36, and the AC LED epitaxial chip 22 may be a surface mounting device (SMD) or have a chip on board (COB) package structure, in addition to the lamp type LED device 22 shown in FIG. 1.

Figure 3:
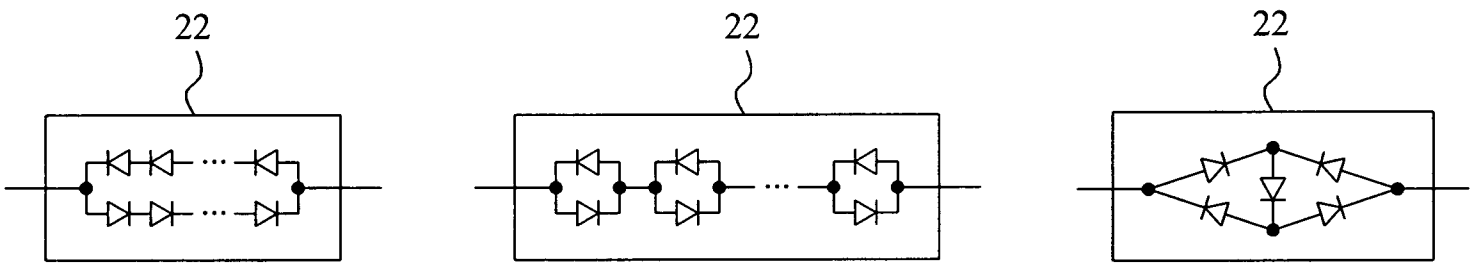
FIG. 3 provides three AC LED epitaxial chips.

An AC LED epitaxial chip including more than two LED electronic elements may be used for the AC LED epitaxial chip 22 to provide brighter illumination. FIG. 3 provides three such AC LED epitaxial chips 22. The first one in the left includes two LED strings parallel connected in opposite directions between two pins of the AC LED epitaxial chips 22, each LED string having two or more LED electronic elements. The second case in the middle includes two or more pairs of LED electronic elements serially connected between two pins of the AC LED epitaxial chips 22, each pair of LED electronic elements parallel connected in opposite directions to each other. The last case in the right includes five or more LED electronic elements having a bridge configuration between two pins of the AC LED epitaxial chips 22. There have been commercial products can be selected for these cases.

Figure 4:
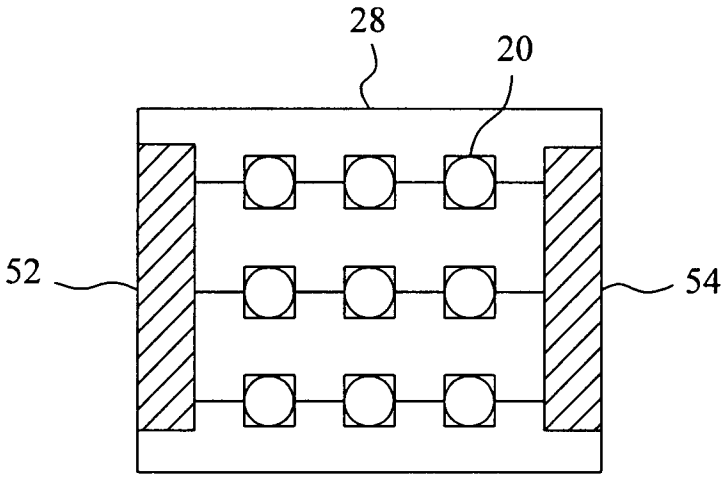
FIG. 4 is a top view of a filament using multiple LED epitaxial chips.

If it is desired to increase the brightness of a LED lamp, more AC LED devices 20 can be connected in series, in parallel, or in series and parallel in the filament. For example, as shown in FIG. 4, a filament includes nine AC LED devices 20 bounded on a circuit board 28 in such a manner that three rows of AC LED devices 20 are connected in parallel between solder pads 52 and 54 on the circuit board 28, and each row includes three AC LED devices 20. If each of the AC LED devices 20 operates at a power of 1 W, the filament shown in FIG. 4 can operate at a power as high as 9 W.

Figure 5:
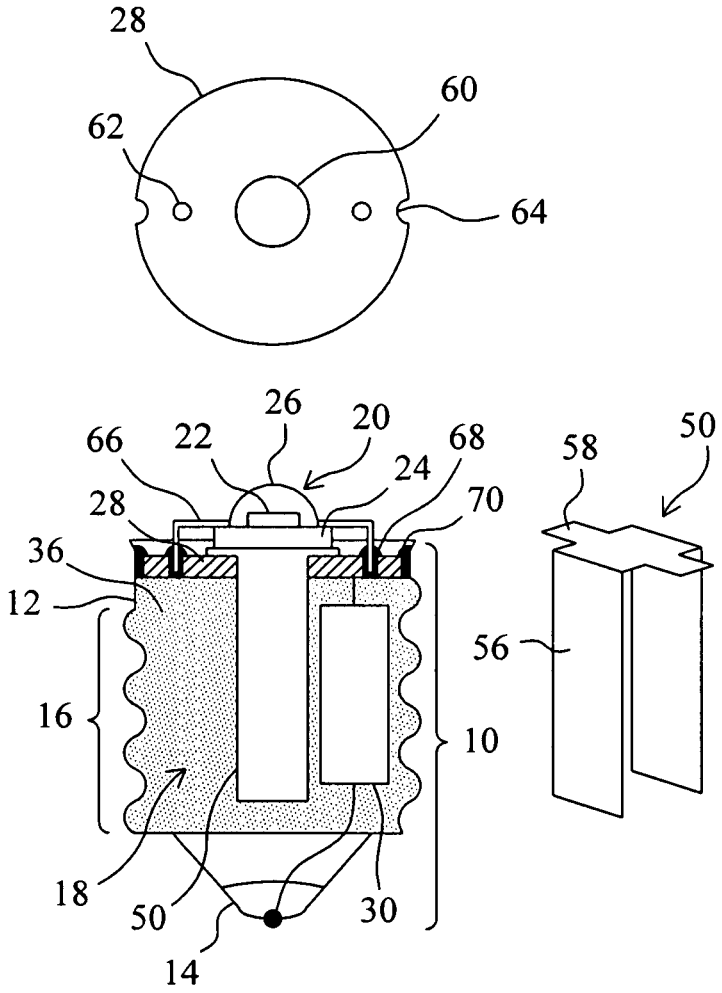
FIG. 5 is a cross-sectional view of a LED lamp in a second embodiment according the present invention.

FIG. 5 provides a second embodiment according to the present invention, in which a circuit board 28 has a through hole 60, a thermally conductive member 50 passes through the through hole 60 and has a first end above the circuit board 28 and a second end buried in a thermally conductive electric insulator 36, and an AC LED device 20 having a plastic leaded chip carrier (PLCC) package structure is bounded to the first end of the thermally conductive member 50. The thermally conductive member 50 has two strips 56 and two flanges 58. Each of the strips 56 has an axial length ranging from 0.1 to 10 cm, preferably ranging from 0.5 to 3.0 cm. The flanges 58 are sandwiched between the AC LED device 20 and the circuit board 28. The circuit board 28 has through holes 62 to be soldered with the pins of the AC LED device 20 by means of solder 68, and through holes 64 to be soldered to an electrode 12 by means of solder 70. The through holes 62 and 64 may be replaced by blind holes or other structures, as is well known in the art of circuit board. A resistor 30 is soldered between an electrode 14 and the circuit board 28 such that the resistor 30 and the AC LED device 20 are connected in series between the electrodes 12 and 14. The circuit board 28 has a glass fiber reinforced substrate or a metal substrate. Preferably, the circuit board 28 is also in mechanical contact with the thermally conductive electric insulator 36. Alternatively, the resistor 30 is bounded on the circuit board 28. In some other embodiments, a second resistor is bounded on the circuit board 28 and connected with the first resistor 30 in series. In these two cases, the resistor bounded on the circuit board 28 may be a variable resistor. If necessary, the LED lamp in this embodiment is provided with a lamp cover 40, as in the previous embodiment.

Figure 6:
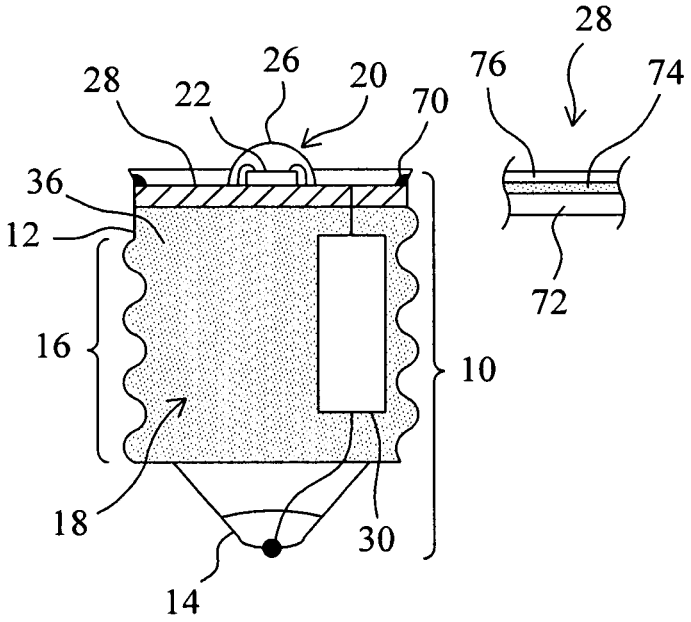
FIG. 6 is a cross-sectional view of a LED lamp in a third embodiment according the present invention.

FIG. 6 provides a third embodiment according to the present invention, in which an AC LED device 20 is bounded to a circuit board 28 with a COB package structure, and the circuit board 28 is attached on a thermally conductive electric insulator 36. The circuit board 28 has an aluminum metal layer 72, a copper metal layer 76, and a thermally conductive layer 74 sandwiched therebetween, and this structure exhibits better heat dissipation capability than a glass fiber reinforced substrate. The circuit board 28 is soldered to an electrode 12 by solder 70, and a resistor 30 is soldered between an electrode 14 and the circuit board 28, such that the resistor 30 and the AC LED device 20 are connected in series between the electrodes 12 and 14. Alternatively, the resistor 30 is bounded on the circuit board 28. In some other embodiments, a second resistor is bounded on the circuit board 28 and serially connected to the first resistor 30. In these two cases, the resistor bounded on the circuit board 28 may be a variable resistor. If necessary, the LED lamp is provided with a lamp cover, as in the previous embodiment. In other embodiments, the AC LED device 20 may be a SMD that is bounded on the circuit board 28 by surface mounting technology (SMT).

Depending on practice applications, it is selected the AC LED device 20 having a rated power ranging from 0.3 to 5 W, preferably from 1 to 3 W, and the resistor 30 preferably having a resistance ranging from 50 to 50,000Ω. In addition, it is selected the AC LED device 20 having a rated input voltage ranging from 12 to 240 V. For a LED lamp using a single AC LED device 20, the rated input voltage of the AC LED device 20 is selected to be 110 or 220 V, depending on the power lines in its application. For a LED lamp using serially connected AC LED devices 20, the rated input voltage of each AC LED device 20 is selected to be smaller, for example 12 V.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A light emitting diode (LED) lamp, comprising:

an LED filament including an LED device;

a lamp base defining a cavity therein and having a first electrode and a second electrode;

a resistor connected in series with the LED device between the first and second electrodes; and a thermally conductive electric insulator filling up the cavity defined by the lamp base and mechanically contacting with the LED filament and the first electrode to provide a thermal channel to transfer heat from the LED device to the first electrode for heat dissipation enhancement when the LED device is powered on.

2. The LED lamp of claim 1, wherein the circuit board is soldered to the first electrode.

3. The LED lamp of claim 1, wherein the thermally conductive member has a flange sandwiched between the LED device and the circuit board.

4. The LED lamp of claim 1, wherein the circuit board has a glass fiber reinforced substrate.

5. The LED lamp of claim 1, wherein the LED device has a plastic leaded chip carrier package structure.

6. The LED lamp of claim 1, wherein the resistor is mounted on the circuit board.

7. The LED lamp of claim 1, wherein the LED filament comprises a circuit board soldered to the first electrode and having the LED device mounted thereon.

8. The LED lamp of claim 7, wherein the circuit board comprises:

an aluminum metal layer in mechanical contact with the thermally conductive electric insulator;

a copper metal layer having the LED device soldered thereon; and a thermally conductive layer sandwiched between the aluminum metal layer and the copper metal layer.

9. The LED lamp of claim 7, wherein the LED device has a chip on board package structure.

10. The LED lamp of claim 7, wherein the resistor is mounted on the circuit board.

11. The LED lamp of claim 1, wherein the thermally conductive electric insulator comprises an epoxy resin, thermal conductor powder, or a mixture thereof.

12. The LED lamp of claim 1, wherein the resistor is buried in the thermally conductive electric insulator.

13. The LED lamp of claim 1, wherein the LED device is configured to operate at an AC voltage ranging from 12 V to 240 V.

14. The LED lamp of claim 1, wherein a rated power of the LED device ranges from 1 W to 3 W.

15. The LED lamp of claim 1, further comprising a lamp cover encapsulating the LED filament.

16. The LED lamp of claim 15, wherein the lamp cover comprises a glass cap, a plastic cap, an epoxy resin cap, or a silicone cap.

17. The LED lamp of claim 1, wherein the lamp base is a standard lamp base for ordinary tungsten light bulbs.

18. The LED lamp of claim 1, wherein the lamp base is a standard lamp base for ordinary halogen light bulbs.

19. The LED lamp of claim 1, wherein the lamp base is one of the standard E12, E14, E17, E26, E27, MR16, and GU10 lamp bases.

* * * * *